United States Patent [19]

Schiffner et al.

[11] Patent Number: 4,549,811

[45] Date of Patent: Oct. 29, 1985

[54] MIXING BOWL SPLATTER GUARD

[76] Inventors: Robert E. Schiffner; Susan R. Montgomery, both of 11900 N. 92nd Pl., Scottsdale, Ariz. 85260

[21] Appl. No.: 498,566

[22] Filed: May 26, 1983

[51] Int. Cl.[4] ..... B01F 7/32; B01F 15/00

[52] U.S. Cl. ..... 366/129; 366/301; 366/331; 366/347

[58] Field of Search ..... 366/347, 244–251, 366/301, 331; 220/DIG. 13, 54, 306, 352; D7/16, 18

[56] References Cited

U.S. PATENT DOCUMENTS

| | | | |
|---|---|---|---|
| 2,193,356 | 3/1940 | Green | 366/347 |
| 2,486,320 | 10/1949 | Ost | 366/347 |
| 2,504,727 | 4/1950 | Post | 366/347 |
| 2,517,648 | 8/1950 | Franke | 366/347 |
| 2,681,211 | 6/1954 | Reynolds | 366/251 |
| 2,858,118 | 10/1958 | Perkins | 366/347 |
| 3,913,896 | 10/1975 | Hawke | 366/347 |
| 3,960,370 | 6/1976 | Bewley | 366/347 |

FOREIGN PATENT DOCUMENTS

| | | | |
|---|---|---|---|
| 1337412 | 7/1962 | France | 366/251 |

*Primary Examiner*—Philip R. Coe
*Assistant Examiner*—Frankie L. Stinson
*Attorney, Agent, or Firm*—Weiss & Holloway

[57] ABSTRACT

A splatter shield is provided for use with a conventional portable mixer having a speed control switch and a pair of laterally spaced drive sockets. A pair of beaters each includes one end portion adapted to be detachably secured within the drive sockets, a shaft having a generally circular member for keeping the ingredients being mixed out of the drive sockets, and beater blades at the opposite end portion. A mixing bowl holds ingredients to be mixed by the beater blades and a splatter shield having a flat bottom is operably disposed on the rim of the bowl for preventing the escape of ingredients therefrom when the mixer is in operation. The shield is preferably made of polypropylene for ease of cleaning, unbreakability and chip-proof characteristics. A central portion of the top integral surface is raised and reinforcing ribs are disposed about the periphery of the top shield surface and radially in toward the raised portion. Relatively wide, spaced apart apertures are provided in the raised portion for (a) inserting socket-engaging end of beaters into drive socket, from bottom of shield; (b) inserting the circular members through the bottom to proximate the sockets; (c) providing a wider range of beater blade mobility within the bowl; (d) lifting beater to increase speed and clean blades by centrifugal force; and (e) using the splatter shield as a stand for the mixer and blades during periods of non-use.

1 Claim, 8 Drawing Figures

FIG. 1
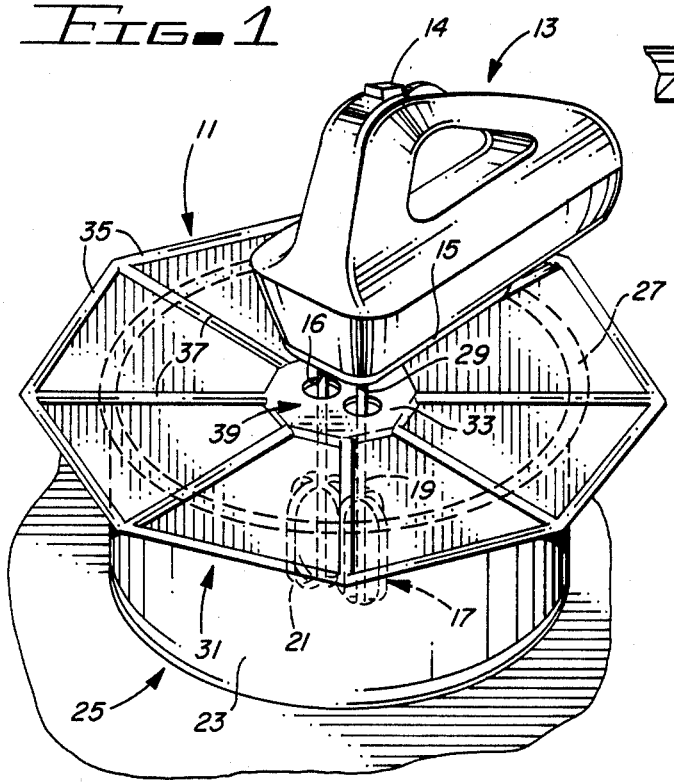
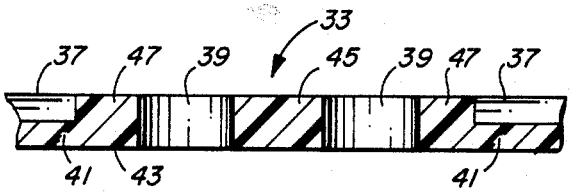
FIG. 4
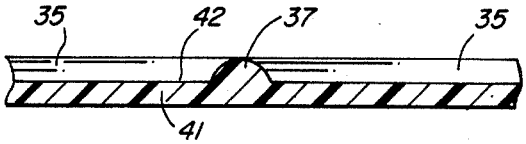
FIG. 5
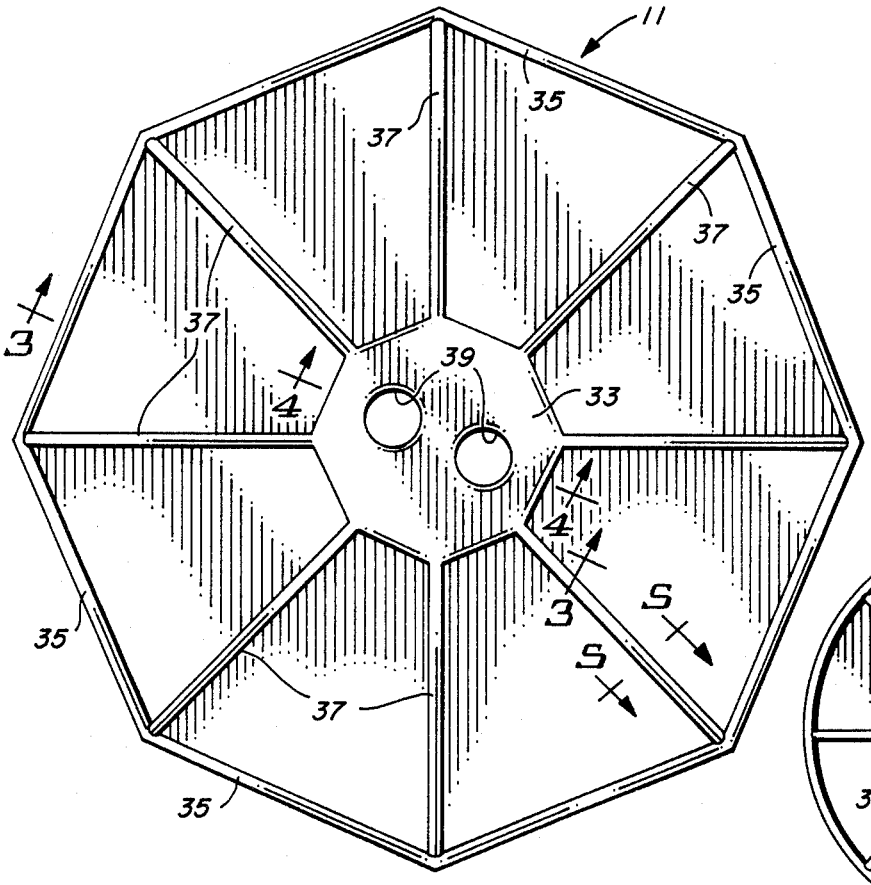
FIG. 2
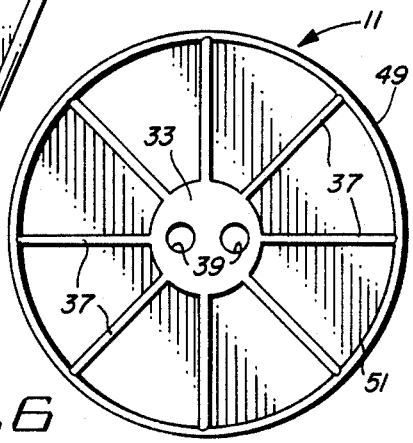
FIG. 6

MIXING BOWL SPLATTER GUARD

BACKGROUND OF THE INVENTION

1. Field of the Invention

This invention relates generally to a mixing bowl cover attachment for a conventional electric mixer and, more particularly, to a removable, reinforced, resilient cover designed specifically to be employed with the twin beater shafts of a conventional, portable, hand-held electric mixer in such a fashion as to substantially eliminate the splattering of the bowl contents during the mixing operation.

2. Description of the Prior Art

In the prior art, the use of a portable hand-held electric mixer to agitate, mix or stir materials in a mixing bowl without some type of cover was replete with problems. When an electric mixer is used at higher speeds, the ingredients in the bowl tend to be thrown outward and splattered outside the mixing bowl by the rotating beaters. This splattering wastes expensive ingredients, necessitates a rather messy cleanup job, often soils the cook's clothing, and can ruin a recipe requiring a precise measurement of ingredients. The prior art mixing operations also compromise kitchen safety since fingers, particularly those of curious little children, can be caught in the rotating beaters and various types of foreign substances can inadvertently get mixed into the bowl with the other ingredients.

The prior art attempted to solve the splattering problem with various forms of splatter guards or bowl covers. Among the patents which propose splatter guard solutions are the following:

| Patentee | Patent Number | Issue Date |
|---|---|---|
| Marie J. Ost | 2,486,320 | October 25, 1949 |
| Frank B. Post | 2,504,727 | April 18, 1950 |
| Frieda S. Franke | 2,517,648 | August 8, 1950 |
| Estelle M. Perkins | 2,858,118 | October 28, 1958 |
| Ethel M. Hawke | 3,913,896 | October 21, 1975 |
| Adele Lorraine Bewley | 3,960,370 | June 1, 1976 |

While the prior art cited above does teach various types of splatter shields in an attempt to solve the problems mentioned above, most proposed solutions serve to create additional problems instead. The proposed splatter guards of the prior art are often complex constructions which are difficult to use, disassemble, and clean. Furthermore, many of the prior art patents are useable only with one specific size of mixing bowl rather than a variety of mixing bowl sizes as desired by housewifes and the like. Some splatter guards are made from fabric-like material and these are extremely difficult to keep clean. Further, the prior art which teaches the use of a plastic material, generally teaches the use of a rigid plastic which is subject to chipping if contacted by the beaters to drop chips of plastic into the mixing ingredients with possible disasterous effects upon the humans consuming the food therein, breakage since rigid plastic sheets break quite easily, deformation and loss of shape since dishwashing, washing in hot water or repeated use can alter the shape of plastic materials.

Even if the prior art taught the use of resilient plastic material for ease of cleaning, inability to break or chip, and the like, serious problems would arise from cleaning and particularly from cleaning in a dishwasher since the typically high dishwasher temperatures will cause shape loss or, deformation, or warpage, as known in the art. Yet further, many of the patents of the prior art extremely limit the range of motion of the beaters within the mixing bowl, make no provision for cleaning the beater while in position over the bowl, and make no provision for using the splatter bowl cover as a stand during periods of nonuse. In summary, the above-mentioned devices are generally complex, expensive, difficult to clean and maintain, difficult to attach, difficult to detach, and difficult to maintain without chipping, breaking, loss of shape, or warpage.

None of the devices of the prior art solve the various problems enumerated above while the mixing bowl splatter guard of the present invention serves substantially all of these problems and provides a relatively low cost, extremely simple splatter guard which is easy to clean, simple in construction, easy to attach and detach from the mixer system, adapted to cover various sized mixing bowls, provides protection against chipping and breaking while simultaneously providing protection against warping to ensure shape retention, can be washed in typical dishwashers, and can be used for cleaning the beaters while in the bowl or as a stand during periods of nonuse.

SUMMARY OF THE INVENTION

The present invention provides a mixing bowl splatter guard or cover useable as an attachment to a conventional hand-held portable electric mixer to prevent splattering or the escape of the ingredients being mixed within a mixing bowl.

The bowl cover splatter shield of the present invention is to be used with a conventional, hand-held, portable electric mixer having a pair of drive sockets, a pair of beaters, each including a beater shaft, beater blades at one end thereof and shaft-engaging means at the opposite end. A circular collar is operably disposed between the ends of the beater shaft and adjacent the socket-engaging ends for protecting the drive sockets from splatter and creep. A polygon or circularly shaped sheet of relative resilient polypropylene having a flat bottom for being operably disposed over the top of the rim of the mixing bowl with the diameter of the sheet being significantly larger then that of the bowl to accomodate various size bowls and permit some movement during operation without producing splatter. The flat bottom is extremely easy to clean and will not chip or break even when contacted by the beater blades such as during the cleaning operation.

A raised central island is disposed in the approximate center of the sheet, is made from polypropylene and is integral with the sheet. A pair of relatively wide diameter apertures are spaced a distance apart so as to enable the splatter guard to be used with the large variety of mixers.

The apertures serve a plurality of functions including (a) easily receiving the socket engaging end of the beaters from the lower side of the sheet through the top for engaging the mixer drive sockets; (b) easily receiving the collars or beater shields therethrough from the bottom to the top for positioning same to protect or shield the mixer drive sockets; (c) permitting a wide degree of freedom of motion of the beater blades within the bowl by tilting the mixer and beater shaft and/or laterally sliding the sheet so as to enable all parts of the mixer bowl to be reached by the beater blades; and (d) enabling opposite sides of the aperture to be positioned against opposite sides of the shaft so that the mixer and top of the sheet can be positioned on a flat surface to act as a stand during periods of nonuse.

Shape retention rib vanes enable the use of the polypropylene by reinforcing the sheet without adding significantly to its cost. The ribs are disposed in a pattern on the top surface of the sheet and extend around the outer periphery and radially inward to the central island, the shape retention ribs enabling the resilient polypropylene to be used to prevent breakage, chipping and the like while enabling the splatter shield of the present invention to be easily cleaned, washed in a dishwasher, etc. without warping or loosing its shape.

Further, the polygon-shaped sheets of the present invention may include any number of sides over five although an octagon shape is illustrated in the preferred embodiment of the present invention. Furthermore, a circular shield could be used, as desired.

The mixer bowl splatter shield of the present invention does, therefore, solve substantially all of the problems of the prior art without yielding to any of the serious disadvantages or drawbacks thereof. Applicant's combined use of a polypropylene sheet together with reinforcing ribs, oversize apertures and a central reinforcing island offer many advantages never taught by the prior art as hereinafter described.

Other advantages and meritorious features of the present invention will be more fully understood from the following description of the drawings and the preferred embodiment, the appended claims and the drawings which are described hereinbelow.

BRIEF DESCRIPTION OF THE DRAWINGS

FIG. 1 is a perspective view of a conventional mixer, mixer bowl, and the mixing bowl splatter guard of the present invention in normal use;

FIG. 2 is a top view of the splatter guard or shield of the present invention;

FIG. 4 is a sectional view taken along lines 4—4 of FIG. 2 showing the central island portion thereof;

FIG. 5 is a sectional view taken along lines 5—5 of FIG. 2 showing the cross section of a radially rib of the present invention;

FIG. 6 is a top view of a circular embodiment of the splatter guard cover of the present invention;

DESCRIPTION OF THE PREFERRED EMBODIMENT

Figure 3:
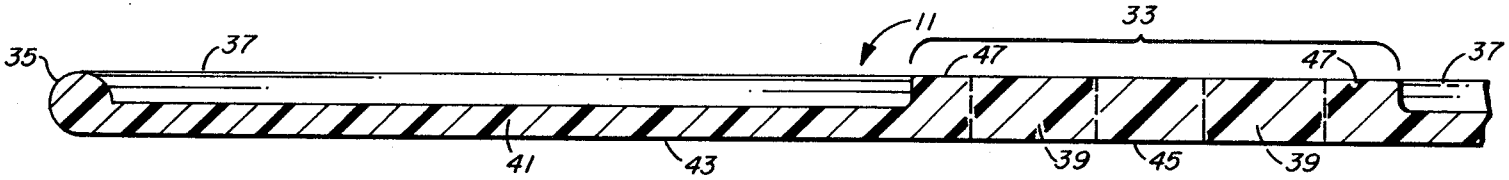
FIG. 3 is a sectional view taken along lines 3—3 of FIG. 2 showing the peripherial rib through the central island section at the center of the sheet.

FIG. 1 shows a conventional hand-held portable electric mixer 13, a mixer bowl cover or splatter shield 11, and a conventional mixer bowl 25 having ingredients 23 to be mixed therein and a top rim 27 upon which the cover 11 rests. The mixer 13 includes a pair of spaced apart drive sockets 15 and a pair of selectively detachable beaters 17. Each beater has an elongated circular beater shaft 19 having beater blades 21 at the lower end therein and a socket-engaging device 29 at the upper end thereof for detachably securing the beater 27 to the drive sockets 15 for driving the beater blades 21. Further, each beater shaft 19 includes a circular collar or beater shield 16 disposed between the socket-engaging end 29 and the beater blades 21 and proximate the socket drive engaging means 29 for preventing splatter from entering the mixer drive sockets 15 or the area thereabout and for further preventing creep which occurs when the ingredients 23 in the bowl 25 slowly climb up the beater shaft 19 toward the drive sockets 15.

The cover or sheet 11 is preferably made from a polypropylene-type material, for example, conventional opaque polypropylene which is generally resilient and easy to clean. The bottom of the sheet 11 is adapted to be operably disposed upon the rim 27 of the bowl 25 and is substantially flat to prevent accidental slippage or the like. Since the sheet is made from polypropylene, it is easy to clean, not subject to normal breakage, and will not chip when struck by the beater blades 21 during cleaning operations or the like or by ingredients 23 in the bowl 25 which are inadvertently thrown by the beater blades 21 against the lower flat surface of the cover 11. This prevents the serious problem of chipping which could cause a piece of plastic material or the like from entering the ingredients 23 and being mixed into the final food product for human consumption thereby causing choking or even death.

The top surface of the splatter shield or sheet 11 includes a raised island portion 33 disposed proximate the center of the sheet 11 for increasing the thickness thereof for reinforcing purposes. The island 33 is also made, preferably, from polypropylene and is integral with the upper surface of the sheet 11. A web or configuration of reinforcing ribs are also made from polypropylene and integral with the top surface of the splatter shield or cover 11 for strengthening the cover to prevent warpage and insure proper shape retention and for enabling the beater blades 21 to contact the flat lower surface 41 of the central portion 33 without causing chipping or breaking. The diameter of the sheet 11 is sufficiently large so that a significant portion of the ends extend beyond the rim 27 of the bowl 25. This allows the beaters 17 to be moved toward the edges of the bowl carrying the shield 11 therewith without exposing an opening in the bowl to permit splatter.

A pair of relatively wide diameter apertures 39 are disposed adjacent to one another proximate and equally space on either side of the middle of the central island 33 which provides the reinforcement necessary to allow wide apertures 39. The apertures serve multiple functions in that they (1) permit the insertion of the socket-engaging end 29 of the beater shaft 19 into the mixer socket 15 from the lower side 41 of the sheet 11 through the apertures 39 and the top thereof; (2) permit relatively easy insertion of the beater shield or collar member 16 through the bottom 41 of the shield 11 and the apertures 39 to a position proximate the mixer drive sockets 15 for protecting the sockets from splatter through the holes 39 or material 23 which creeps up the shaft 19 toward the sockets 15; and (3) permits the splatter guard 11 to be used as a mixer stand as hereinafter described with reference to FIG. 8.

The top surface of the splatter shield 11 includes a web or network of rib-like members which are also made from polypropylene and integral with the top surface of sheet 11. The rib network provides the necessary reinforcement to protect the polypropylene sheet 11 against loss of shape while allowing it to be washed in automatic dishwashers and the like. In the preferred embodiment, a plurality of ribs 31 extend around the periphery of the sheet 11 from vertice to vertice of the polygon shape and a similar number of radial ribs 37 extend from each vertice at the other end of the sheet 11 to a corresponding vertice of the raised island 33 which is, preferably, also shaped like a polygon but its verticy is lined with the verticies at the outer edge of the sheet 11.

FIG. 2 shows a top view of the mixer bowl cover 11 of FIG. 1 and illustrates the polygon shape of the outer periphery of the sheet 11 and the polygon shape of the raised island portion 33. The polygon may have any number of sides. The outer peripheral ribs 35 extend from vertice to vertice about the perimeter of the polygon sheet 11 while the radial ribs 37 extend from the verticies on the outer periphery of the sheet 11 to the verticies on the raised island 33. The oversized apertures 39 are shown as positioned within the reinforcing island 33. Island 33 strengthens the area about the central portion of the cover 11 which would normally be weakened by the wide diameter apertures 39 and the combination of the reinforcing island 33, and the network of ribs 35, 37, all of which are integral with the top surface of sheet 11, provides sufficient reinforcement and shape retention to enable polypropylene to be used instead of a conventional, generally rigid plastic which would be subject to chipping, breaking and the like. Furthermore, the polypropylene is easier to clean and can be washed in conventional hot water dishwashers since the rib network 35, 37 will prevent it from loosing its shape.

FIG. 3 is a cross section of the splatter shield 11 of FIG. 2 taken along view lines 3—3 thereof and shows a segment of the sheet from the outer periphery to the far side of the central island portion 33. The bottom of the sheet 41 is shown as having a substantially flat surface 43 which terminates in a peripheral rib 35. A radial rib 37 is shown as extending from a periphery vertice into a corresponding vertice of the central island portion 33. The raised edge portion 47 of the island 33 is, as shown in FIG. 3, generally shaped like a polygon, similar to the peripheral polygon; and the center portion 45 provides the spacing between the apertures 39 which enable the apertures to be used with a wide variety of mixers 13 and beaters 17. The raised portions 45 and 47 surround the apertures 39 for reinforcement purposes as previously mentioned.

FIG. 4 shows a partial cross sectional view taken along lines 4—4 of FIG. 2 to amplify the raised central island 33 and apertures 39. A bottom portion 41 of the cover shield 11 is shown as having a relatively flat bottom 43. The raised island portion 33 includes the outer edge portion 47 and the central aperture separating portion 45. The apertures 39 are on either side of the middle portion 45 and a pair of radially extending ribs 37 are shown as being integral with the raised portion 47 and extending outwardly therefrom toward the periphery of the cover 11. The diameter of the apertures 39 is approximately a third of the diameter of the central portion 33, while the thickness of the bottom of 43 of sheet 11 is approximately equal to the thickness of the upper ribs 35, 37. A significant advantage of the peripheral ribs 35 and radial ribs 47 is that they provide significant reinforcement and shape retention without adding significantly to the weight or cost of the mixer bowl cover 11 of the present invention.

FIG. 5 shows a cross section of a radial rib taken along view lines 5—5 of FIG. 2 and illustrates the bottom portion 41 of sheet 11, a radial rib 37 integral therewith and extending upward from the top surface 42 of the sheet 11 a distance approximately equal to the thickness to the bottom portion 41. Peripheral ribs 35 can also be seen and are similarly integral with the top surface 42 and extending therealong to a height approximately equal to the thickness of the bottom portion 41 of the sheet 11, as previously described.

FIG. 6 shows an alternate embodiment of the present invention wherein the polypropylene sheet 11 has a circular perimeter 49 rather then a polygon as in FIG. 2. The network of ribs in FIG. 6 includes either a single piece or plurality of individual pieces of peripheral rib 51 extending upwardly from the top surface of the sheet 11 around the entire circumference of its circular shape and a plurality of radially extending ribs 37 connecting the circular inner island 33 to the peripheral rib 51 to produce a wagon wheel effect and provide sufficient reinforcement to insure shape retention and sufficient strength to enable the use of polypropylene for the splatter shield 11 of the present invention.

In the preferred embodiment of the present invention, the polygon-shaped splatter shield 11 of FIG. 2 is preferably an octagon having eight equal length sides about the periphery thereof and a similar but shorter eight equal sides about the central island portion 33. Eight outer or peripheral ribs 35 are necessary for connecting each of the eight verticies of the polygon and a similar eight radial ribs 37 are required for connecting each of the eight outer verticies to the corresponding eight verticies of the inner island 33. However, even though an octagon shape is shown in the preferred embodiment, it will readily be observed that any suitable shape can be used which performs the functions stated herein.

Figure 7:
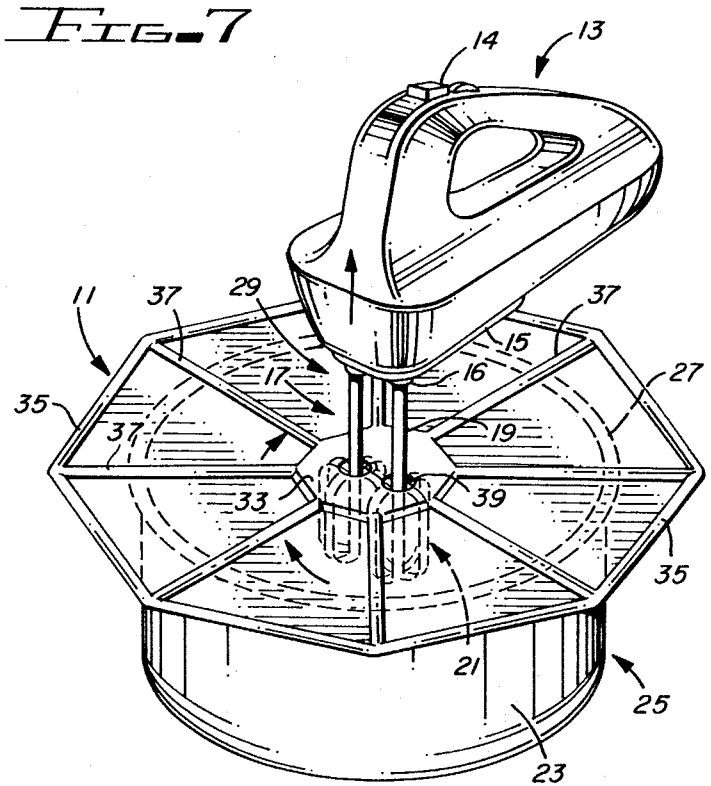
FIG. 7 is a perspective view of the mixer, beaters, splatter guard, and mixing bowl in operative position for cleaning the beater blades within the bowl.

FIG. 7 shows an electric mixer 13 having controls 14 which may, for example, include an on/off speed control switch plus a push button to eject the beaters 17 when the mixing operation is finished. A useful advantage of the splatter shield 11 of the present invention resides in the fact that the reinforcement provided by the ribs 35, 37 and the raised central portion 33 about the apertures 39 enable the mixer 13 to be lifted vertically into proximate contact with the apertures 39 and the speed turned up by control means 14 so as to throw all excess ingredients 23 from beater blades 21 by the centrifigal force produced by blade rotation when the speed is sufficiently high. This is possible due to the reinforced central portion 33 and the reinforcement effect of the ribs 35, 37 which enable polypropylene to be used and thereby prevent chipping or breaking which would normally be produced if the beater blades 21 come into contact with the lower surface 41 of the sheet 11.

Figure 8:
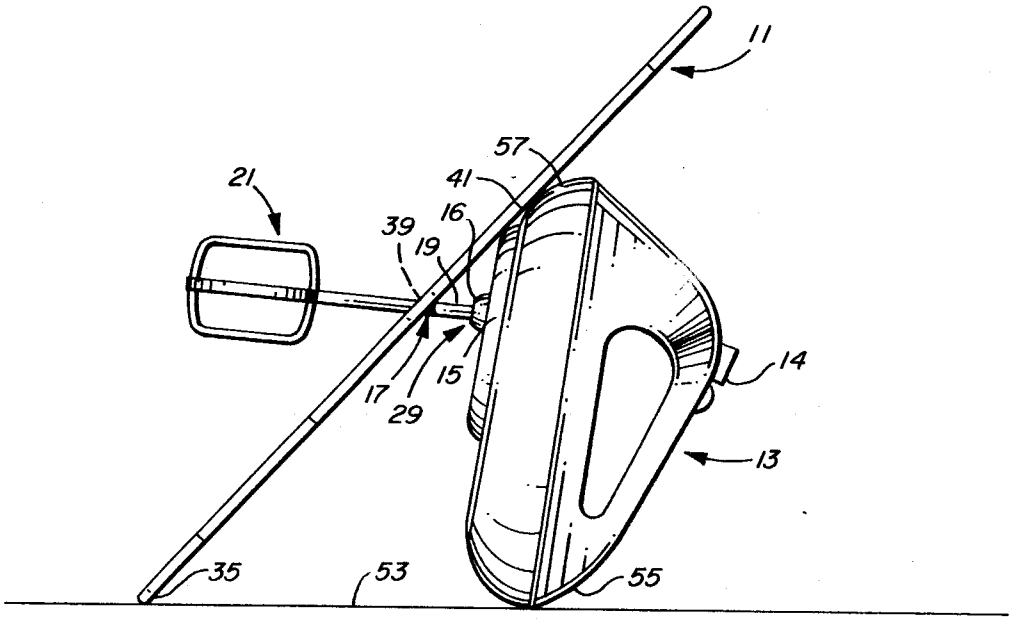
FIG. 8 is a perspective view of the mixer, beaters, and splatter guard of the present invention used as a stand during periods of nonuse.

Similarly, the splatter shield 11 of the present invention serves an additional purpose. As shown in FIG. 8, it may be used as a mixer stand during periods of nonuse and this feature is made possible, at least partially, by the use of applicant's oversize apertures 39 through the central portion 33 of the shield 11. When the mixer 13 is to be stood up, it is lifted off of the bowl along with the beaters 17 and splatter shield 11. The rear bottom 55 of the mixer is rested on a relatively flat surface such as a counter top 53 or the like while the peripheral rib 35 portion about the periphery of the splatter shield 11 is also rested on the surface 53. The top side of the apertures 39 traps or engages the top side of the beater shafts 19 while the bottom side of the apertures 39 engages the opposite side of the beater shafts 19 causing a pinching effect which adds to the stability of the stand and enables its use. Further, the top of the mixer 13 rests against the top surface of the splatter guard 11 adjacent the outer portion on the top side thereof so that the mixer 13 stands nearly upright and the splatter shield 11 extends from its contact area 57 at the top of the mixer 13 to the rib 35 contacting surface 53 at an angle of approximately 45 degrees. This results in the bottom side 43 which may or may not be covered with splattered ingredients 23 disposed generally upward and prevents the flow of the ingredients 23 off of the splatter guard 11 for normal mixtures while the drippings from the beater blades 21 are caught by the lower surface 43 and merged with the splattered ingredients 23 already stuck thereon. The use of the splatter guard 11 in combination with the beater 17 and mixer 13 to form a stand therefor is yet another advantage of the present invention and is made possible, at least partially, by the oversize holes or apertures 39.

With this detailed description of the specific apparatus used to illustrate the present invention and the operation thereof, it will be obvious to those skilled in the art that various modifications can be made therein without departing from the spirit and scope of the present invention which is limited only by the appended claims.

We claim:

1. A bowl cover splatter shield for use with a hand-held portable electric mixer having a pair of drive sockets and a pair of beaters for mixing ingredients in a mixing bowl having a rim, each beater including a beater shaft, beater blades integral with one end of said shaft and a socket-engaging end at the opposite end thereof for removably engaging one of said drive sockets, each of said shafts including a circular collar operably disposed between said shaft ends substantially proximate to said socket-engaging end, said blow cover splatter shield comprising:

a relatively thin octagon-shaped sheet of relatively soft and resilient polypropylene plastic material having eight equal sides and a flat bottom adapted to be evenly disposed on top of the rim of said mixing bowl in order to allow said sheet to operably slide on top of said rim, the diameter of said sheet being larger than that of said mixing bowl, said flat bottom being adapted to contact said beater blades when said beater blades are raised during cleaning operations within said bowl without chipping or breaking said splatter shield while simultaneously increasing cleanability and ease of material removal;

a raised central island of relatively soft and resilient polypropylene plastic material disposed in the approximate center of said octagon-shaped sheet for reinforcing same, said central island being integral with the top of said sheet and having a raised octagon shape with eight equal sides, said octagon shape of said raised central island being concentric with said octagon-shaped sheet and the sides of said octagon shape of said raised central island being parallel to the corresponding sides of said octagon-shaped sheet;

said raised central island having a pair of generally circular apertures spaced apart a distance approximately equal to the distance between each of said drive sockets for (a) removably passing the socket-engaging ends of said beater shafts from the flat bottom through the top of said sheet for insertion into the mixer drive sockets, (b) removably passing said circular collars through said sheet in order to prevent any of the material being mixed in said mixing bowl from splattering into said drive sockets, (c) providing increased freedom of motion of the beater shaft in order to provide increased freedom of movement of said beater blades for more thorough mixing throughout said mixing bowl, and (d) allowing said octagon-shaped sheet to be used as a stand for said mixer during periods of non-use, said apertures being operably disposed with respect to the sides of said octagon-shaped sheet in order to allow said sheet to be used for the purpose of standing up said mixer, said apertures being oriented with respect to the sides of said octagon-shaped sheet so that a line lying on the plane of said octagon-shaped sheet and passing through both centers of said apertures is both perpendicular to a first pair of the sides of said octagon-shaped sheet and parallel to a second pair of the sides of said octagon-shaped sheet, said mixer being operably positioned with respect to said octagon-shaped sheet in order to use said sheet for standing up said mixer by moving said beater shafts through said apertures a sufficient distance to allow said sheet to be rotated so that one end of said mixer will rest on a horizontal surface, the other end of said mixer will rest against said sheet and one side of said sheet will rest on said horizontal surface such that said mixer remains in a standing position and said sheet makes an angle of approximately forty-five degrees with said horizontal surface for preventing splattered mixer material from rapidly running off of the flat bottom of said sheet and for allowing said flat bottom to catch the splattered mixing material dripping off of said beater blades; and shape retention rib means integral with the top surface of said octagon-shaped sheet and having a height approximately equal to the height of said raised central island for added reinforcement and shape retention of said sheet, said rib means made out of relatively soft and resilient polypropylene plastic material and including eight elongated ribs of equal length operably disposed from vertice to vertice of said sheet around the perimeter thereof and eight radial ribs extending radially from the perimeter of said sheet to said raised central island, each of said eight radial ribs being of equal length and extending from a vertice at said perimeter of said octagon-shaped sheet to a corresponding vertice at the perimeter of said octagon shape of said raised central island, said elongated ribs and said radial ribs together with said raised central island structurally form eight identical four-sided polygons connectively adjacent each other and surrounding the periphery of said raised octagon-shaped island.

* * * * *